United States Patent [19]

Thompson

[11] 4,041,716

[45] Aug. 16, 1977

[54] SUPPORT STRUCTURE FOR A FLOATABLE MARINE DOCK

[76] Inventor: Thomas L. Thompson, 1531 Monrovia, Newport Beach, Calif. 92663

[21] Appl. No.: 608,880

[22] Filed: Aug. 29, 1975

[51] Int. Cl.[2] ..... B63B 35/00

[52] U.S. Cl. ..... 61/48; 114/266

[58] Field of Search ..... 61/48, 63; 52/617; 114/.5 F, .5 BD

[56] References Cited

U.S. PATENT DOCUMENTS

| | | | |
|---|---|---|---|
| 2,857,872 | 10/1958 | Usab | 61/48 |
| 3,091,203 | 5/1963 | Usab | 61/48 |
| 3,128,737 | 4/1964 | Usab | 114/.5 R |
| 3,179,076 | 4/1965 | Sheffield | 114/.5 R |
| 3,285,311 | 11/1966 | Cushman | 52/617 |
| 3,448,709 | 6/1969 | Hardwick, Jr. | 114/.5 R |
| 3,760,754 | 9/1973 | Drummond et al. | 61/48 |

FOREIGN PATENT DOCUMENTS

| | | | |
|---|---|---|---|
| 92,747 | 8/1956 | Netherlands | 61/48 |

*Primary Examiner*—Paul R. Gilliam
*Assistant Examiner*—Alex Grosz
*Attorney, Agent, or Firm*—Francis X. LoJacono

[57] ABSTRACT

A support structure in combination with a flotation cell adapted to support a floatable marine dock or the like, wherein the cell comprises a buoyant, rectangular, hollow, box-shaped housing formed as a thin-walled float provided with oppositely disposed, threaded bushings molded therein in such a manner as to threadably receive a continuously threaded rod that extends across the entire width of the float, thereby rigidly interconnecting the oppositely disposed side walls thereof. The rods are positioned to protrude on each side of the float to additionally support and mount the dock frame structure, whereby stresses placed on the dock are transmitted to the rod and absorbed thereby.

4 Claims, 5 Drawing Figures

10
18
34
22
2
55
50
41
43
41
12
16
26
28
56
2
22
42
14
28
12

22
55
54
20
12

10
50
52
45
36
18
56
55
52
50
47
46
36
44
34
38
36
42
42
14
40
26
40
22
12
16
28
28
24
20

10
50
52
56
18
12
16
42
40
22
45
30
14
46
44
32
32
26
34
47
38
36

32
32
30

SUPPORT STRUCTURE FOR A FLOATABLE MARINE DOCK

BACKGROUND OF THE INVENTION

1. Field of the Invention

This invention relates to floatable marine docks and, more particularly, to the combination of a support structure and a float cell.

2. Description of the Prior Art

As is well known in the art, various types of floating docks are presently available and in use. However, each of these types of floating docks have several inherent problems and difficulties. That is, the material used in the known devices, which have historically been used to provide buoyancy in both salt and fresh water have consistently been found wanting because of the marine environment—particularly with respect to those floatable docking units that are located in a salt water environment, the salt water causing a relentless deterioration of the exposed components and materials thereof.

The most notable materials that have consistently failed over predetermined periods in this use are: woods of various types, such as logs, boxes, etc.; hollow, fiberglass structures having an endless variety of shapes; metal tanks; concrete pontoons which are generally filled with expanded, polystyrene-foam-plastic blocks that are supposedly arranged to prevent the intrusion of water entering through cracks therein; but, however, it invariably occurs. Additionally, unprotected blocks of styrene foams and urethane foams have also been incorporated within floating dock units without any great success, as these foams desintegrate rather quickly under the harsh conditions found therein.

Again, it should be noted that an infinite number of combinations of the above materials have been tried in the ancient battle to maintain a rugged, long-lasting, docking unit.

Accordingly, several types of construction methods have been tried with the above materials, wherein the most common method is the construction of additional wood framework thereto in order to provide a platform or deck area. This wood framework is generally constructed as a separate entity from the floatation devices, the floatation device being positioned under the deck or platform, wherein the framework is attached to the floating units. This type of construction is found to a large extent in marine installations where they are used to provide slips for pleasure boats which are large enough to require berthing.

These pontoons are arranged in straight lines and are held in a juxtaposed position to each other by wood beams, which are fastened to the longitudinal sides of the deck by means of steel bolts which are received in steel nuts that are embedded into the concrete and terminate therein. Thus, all stresses placed upon the dock of this type are transferred to the bolts therein and provide a very weak connection having a very short life expectancy.

SUMMARY OF THE INVENTION

This invention provides a support structure in combination with a floatation cell, wherein at least one cell is included in the construction of a floating dock used for docking boats thereto, particularly in small boat marinas. Generally, a plurality of floatation cells are juxtapositioned to each other in various relationships to form dock areas having a plurality of berthing slips for any number and sizes of boats.

The floatation cell comprises a buoyant housing formed as a one-piece, integral unit having a substantially-rectangular, hollow, box-like configuration. This unit is molded from a high-density-polyethylene material which is well-known for its strength and durability when exposed to adverse elements and conditions, such as those found in most bodies of water, particularly those having salt water therein. Thus, the cell is impervious to marine environment and will last indefinitely as a dock-floatation unit.

When molded, there is included within the walls thereof a plurality of threaded bushings. However, the bushings positioned on opposite side walls thereof are in axial alignment with each other. That is, one bushing of one wall is aligned with a matching bushing on the opposite wall. Thus, the bushings are arranged to receive a continuously-threaded support rod which is threaded into one bushing; and, as it is continuously being threaded, the rod automatically enters the oppositely disposed bushing, thereby interconnecting each wall thereof. Accordingly, the rod traverses the entire width of the hollow cell, wherein each free end of the rod extends outwardly from each side wall. This extension provides a means for attaching the wooden framework of the dock structure to a cell, or a plurality of cells.

The dock structure generally includes double, longitudinally-arranged, side planks through which the free, extended ends of the rods are received and secured thereto. Affixed to the side planks are a decking means which usually consists of a plurality of transversely-disposed, short planks. The dock structure, particularly the side planks, are subjected to constant forces and stresses, both from the continuous motion and action of the water, and from engagement with boats decked thereto.

OBJECTS AND ADVANTAGES OF THE INVENTION

The present invention has for an important object a provision for a support structure in combination with a floatable cell which is so arranged therewith that all forces and stresses placed upon the floating dock comprised thereof will be directly transferred to and absorbed in the support structure, whereby the cell is unaffected thereby.

It is another object of the invention to provide a support structure for a marine dock that comprises a continuously threaded rod that extends through both oppositely disposed sides of the floatable cell.

It is still another object of the invention to provide a support structure for a marine dock wherein the float cell defines a sealed floatation unit molded from a high-density-polyethylene material impervious to marine environment and that will last indefinitely as a dock floatation unit, if it is properly used.

It is a further object of the invention to provide a floating dock of this character that is simple and rugged in construction.

A still further object of the invention is to provide an apparatus of this character that is easy to service and maintain.

It is a further object of the invention to provide an apparatus of this character that is relatively inexpensive to manufacture.

The characteristics and advantages of the invention are further sufficiently referred to in connection with the accompanying drawings, which represent one embodiment. After considering this example, skilled persons will understand that variations may be made without departing from the principles disclosed or modes of operation that are properly within the scope of the appended claims.

DESCRIPTION OF THE DRAWINGS

Referring more particularly to the accompanying drawings, which are for illustrative purposes only.

DESCRIPTION OF THE PREFERRED EMBODIMENT

Figure 1:
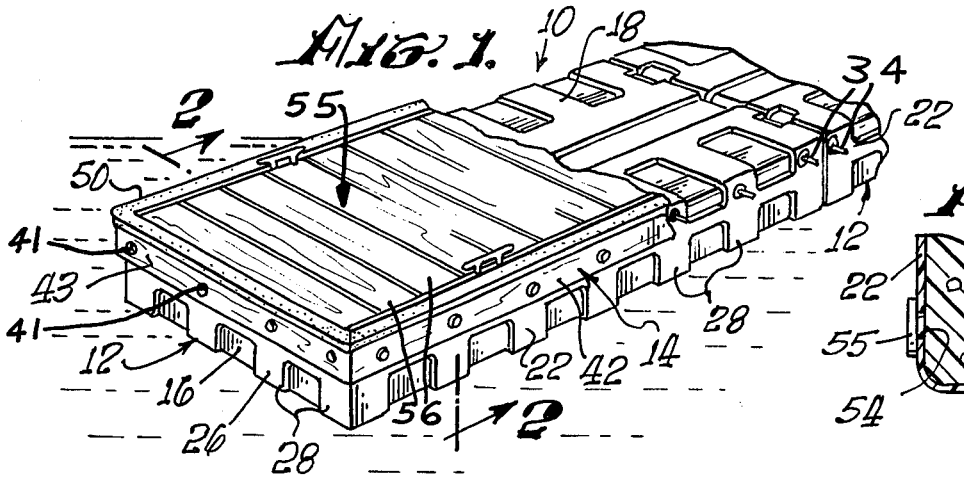
FIG. 1 is a perspective view showing a portion of a floating dock having parts thereof broken away.

Referring more particularly to the drawings, there is shown in FIG. 1 a portion of a floating dock, indicated generally at 10. As illustrated therein, the dock 10 comprises a plurality of floatation cells, generally designated at 12, being juxtaposed in end-to-end relationship with each other. However, each floatable cell is not necessarily connected to the other, other than by the dock-frame structure, generally indicated at 14.

The floatation cells 12 comprise a one-piece, buoyant, substantially-rectangular, box-like housing molded as a thin-walled, float unit. The unit is manufactured from a high-density-polyethylene material capable of being exposed to various adverse environmental conditions, such as sea water.

The floatation cell or float unit 12 comprises end walls 16, top wall 18, bottom wall 20 and side walls 22 and 24. By the integral formation of all the walls, there is provided an air-tight or sealed chamber 26. To give added strength to the box-like float, the walls thereof are additionally formed with integrally-contoured, strengthening ribs 28.

Figure 3:
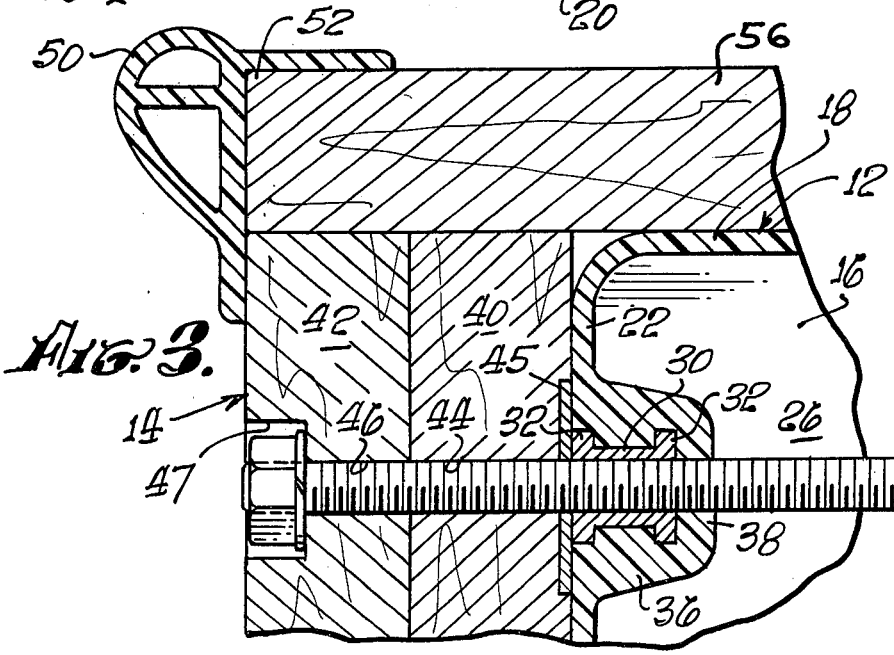
FIG. 3 is another enlarged, sectional view illustrating one end of the continuously threaded rod as it is secured to the floatation unit and dock structure thereof.
Figure 4:
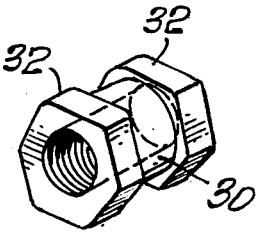
FIG. 4 is a perspective view of the threaded bushing which is molded directly within the cell walls.

When the float or cell 12 is molded, there is integrally mounted within the end walls 16 and side walls 22 and 24 a plurality of threaded bushings 30. Bushing 30, as seen in FIGS. 3 and 4, includes end flanges 32 wherein said flanges are embedded within the molded material of the walls—thereby preventing any rotational movement of the bushing during the threading of the continuously threaded rod 34.

As the cell 12 is formed, the bushing are completely encapsulated, as the polyethylene material is molded, in such a manner that the entire bushing is covered, wherein a jacket 36 protrudes inwardly of the cell chamber 26, leaving the walls flush.

Due to the molding process, which is well known and not part of this invention, the inward-projecting end of the bushing 30 is caused to be also covered with an even thickness of plastic material. At this point, a sealing means is formed thereby, as indicated at 38, and the effect thereof will hereinafter be described.

Accordingly, one of the basic features of the present invention includes the use of the continuously threaded rod which ties both side walls in a rigid relationship and, as will be understood, provides a means by which forces and stresses can be transferred and absorbed by the rod itself.

Figure 2:
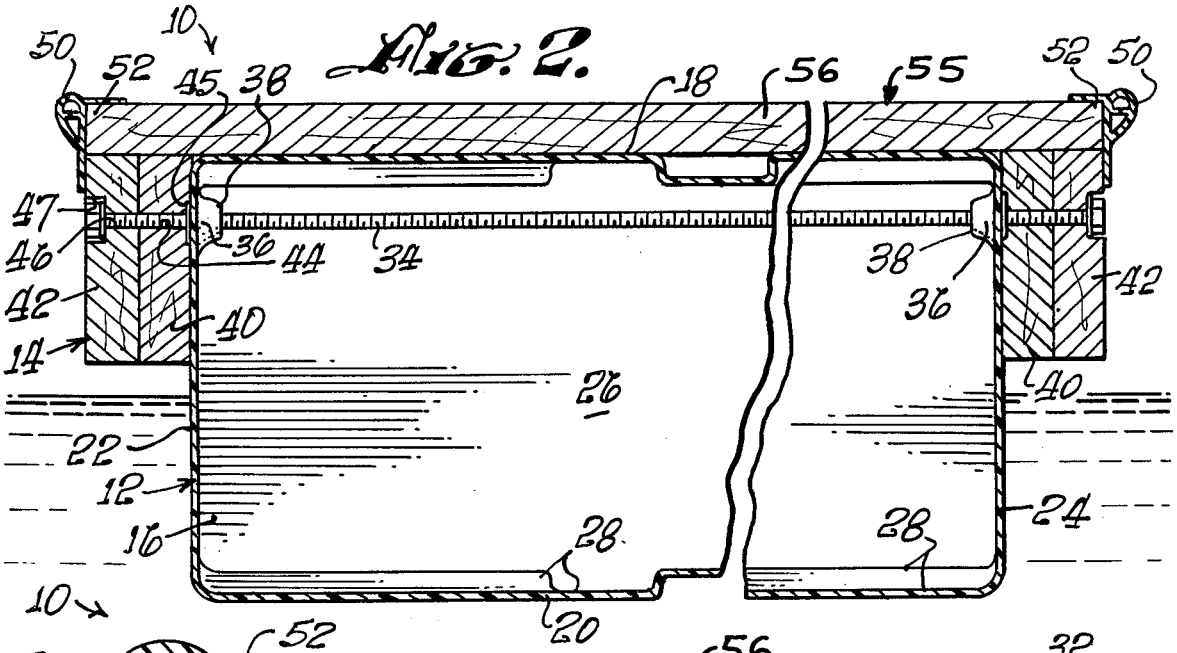
FIG. 2 is an enlarged, cross-sectional view taken substantially along line 2—2.

To mount the rod 34 as seen in FIG. 2, the rod is threaded into one side wall, such as 24. Prior to this, however, each jacket 36 is punctured at 38, allowing the rod 34 to pass into chamber 26 from wall 24 and enter the oppositely disposed bushing disposed in wall 22, as seen in FIG. 3. Since each bushing is axially aligned, the rod enters readily with the opposite bushing as it is rotated. The length of the rod 34 is so determined as to project evenly from both walls 22 and 24, respectively.

Accordingly, this allows the docking structure to be mounted thereto as shown in the drawings. The docking structure in this particular application—longitudinal, side-frame members 40 and 42, respectively. Frame member 40 is referred to as a sub-frame member and member 42 as an outer frame member.

Said sub-frame member is first mounted to the floatation cells by having holes 44 therein aligned to match each extending rod 34. A protective washer 45 can be interdisposed between the sub-frame 40 and the cell walls to protect the bushings 30.

After sub-frame 40 is mounted, outer frame member 42 is then mounted thereover. The outer frame member 42 is provided with aligned holes 46 having an enlarged counter bore 47 in which the rod nut 48 and washer 49 are received therein in order to form a flush, unobstructed, side member.

Thus, it can be seen that many cells can be mounted, one after the other, whereby varying lengths of docks can be constructed by tying them together with the side-frame members 40 and 42.

It should be noted that end walls 16 are also provided with molded bushings 30, as previously described; however, studs 41 are threaded thereto in place of the elongated rods 34. Hence, the studs 41 project outwardly only, thus allowing the end-frame member 43 to be removably affixed to cell 12 along wall 16, as seen in FIG. 1.

To complete the dock construction, a decking means is mounted to the side frame members 42 and 40, said decking means generally indicated at 55, as herein shown, comprises a plurality of juxtapositioned planks 56 laid traversely across each floatation cell 12, and are secured individually in any suitable, well-known manner to the frame structure.

Dock fender 50 is applied along the projecting edges 52, said fender being shown as a continuous, extruded, vinyl trim.

Figure 5:
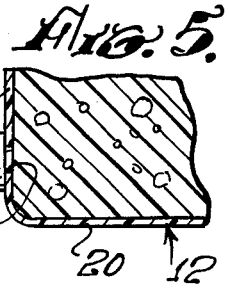
FIG. 5 is a view showing the float as having a foam material disposed therein.

Referring to FIG. 5, the cell 12 is shown having an opening 54, wherein a foam material will be introduced into chamber 26, and thereafter be sealed by cap 55.

The invention and its attendant advantages will be understood from the foregoing description and it will be apparent that various changes may be made in th form, construction and arrangement of the parts of the invention without departing from the spirit and scope thereof or sacrificing its material advantages, the arrangement hereinbefore described being merely by way of example, and I do not wish to be restricted to the specific form shown or uses mentioned, except as defined in the accompanying claims.

I claim:

1. A support structure for a floatable marine dock comprising:

a floating cell defining a sealed, buoyant housing having end walls, a top wall, a bottom wall and side walls formed from a high-density-polyethylene material, wherein said side walls include a plurality of inwardly protruding jackets;

a plurality of support rods, each continuously threaded throughout the length thereof, each of said rods being threaded through oppositely aligned bushings, thereby forming a rigid structure therebetween, wherein each rod projects outwardly from said side walls thereof;

sealing means provided by said jackets for sealing engagement with said rods to prevent leakage within said cell;

a plurality of threaded bushings integrally formed within the side walls and molded within said jackets thereof, said bushings in one of said side walls being oppositely disposed to said bushings in said other side wall, and wherein opposite bushings are axially aligned with each other; and a dock-frame structure demountably attached to said projecting ends of said support rods.

2. A support structure as recited in claim 1, wherein said floatation cell includes:

a plurality of threaded bushings molded within each end wall thereof; and a threaded stud member threadably supported in each bushing mounted in said end walls thereof.

3. A support structure as recited in claim 2, wherein said floatation cells includes a sealed, buoyant housing formed in a substantially-box-like configuration having a plurality of integrally formed rib members, whereby additional rigidity is provided to said cell.

4. A support structure as recited in claim 3, wherein said dock-frame structure includes:

a pair of side-frame members secured to said support rods;

an end-frame member secured to said stud members; and a decking attached to said frame members, wherein a plurality of cells are juxtapositioned in an end-to-end manner, each cell being secured to said side-frame members.

* * * * *